US007494399B2

(12) United States Patent
Tsai et al.

(10) Patent No.: US 7,494,399 B2
(45) Date of Patent: Feb. 24, 2009

(54) SINGLE-STEP FIBER GRINDING PROCESS AND APPARATUS

(75) Inventors: Ying-Chien Tsai, Kaohsiung (TW); Yu-Kuan Lu, Nan-Tou Hsien (TW); Yu-Da Liu, Taichung Hsien (TW); Wood-Hi Cheng, Kaohsiung (TW)

(73) Assignee: National Sun Yat-Sen University, Kaohsiung (TW)

( * ) Notice: Subject to any disclaimer, the term of this patent is extended or adjusted under 35 U.S.C. 154(b) by 0 days.

(21) Appl. No.: 11/772,914

(22) Filed: Jul. 3, 2007

(65) Prior Publication Data

US 2008/0096468 A1 Apr. 24, 2008

(30) Foreign Application Priority Data

Sep. 25, 2006 (TW) ..... 95135358 A

(51) Int. Cl.
*B24B 49/00* (2006.01)

(52) U.S. Cl. ..... 451/11; 451/41; 451/59; 451/313; 451/314; 451/317; 385/78; 385/85

(58) Field of Classification Search ..... 451/41, 451/54, 10, 11, 59, 313, 314, 317; 385/78, 385/79, 85

See application file for complete search history.

(56) References Cited

U.S. PATENT DOCUMENTS

| | | | | |
|---|---|---|---|---|
| 4,839,993 | A * | 6/1989 | Masuko et al. | 451/283 |
| 4,979,334 | A * | 12/1990 | Takahashi | 451/271 |
| 5,265,381 | A * | 11/1993 | Takahashi | 451/41 |
| 6,565,423 | B1 * | 5/2003 | Matsunaga et al. | 451/270 |
| 2003/0073379 | A1 * | 4/2003 | Katakura et al. | 451/1 |

FOREIGN PATENT DOCUMENTS

| | | |
|---|---|---|
| TW | I238097 | 8/2005 |

* cited by examiner

*Primary Examiner*—Eileen P. Morgan
(74) *Attorney, Agent, or Firm*—Darby & Darby P.C.

(57) ABSTRACT

A fiber grinding process includes: contacting an end of the optical fiber with a grinding surface in such a manner that a central axis of the optical fiber at the end is inclined to the grinding surface; rotating the optical fiber about the central axis; and changing a contact pressure between the end of the optical fiber and the grinding surface by applying a variable torque while rotating the optical fiber. A substantially cone-shaped end face with a substantially elliptic cross-section may be produced. A fiber grinding apparatus is also disclosed.

10 Claims, 7 Drawing Sheets

SINGLE-STEP FIBER GRINDING PROCESS AND APPARATUS

CROSS-REFERENCE TO RELATED APPLICATION

This application claims priority of Taiwanese Patent Application No. 95135358, filed on Sep. 25, 2006.

BACKGROUND OF THE INVENTION

1. Field of the Invention

This invention relates to a fiber grinding technique, more particularly, to a fiber grinding process and apparatus that employs a single-step grinding technique to asymmetrically shape an end face of an optical fiber.

2. Description of the Related Art

Nowadays, optical fibers have been used widely in daily activities of people, for instance, in transmitting images, voices, data, etc. Since optical fibers have the properties of high capacity, high quality and high speed, they have been substituted increasingly for conventional communication cables.

Referring to FIG. 1, a typical optical fiber 1 has a fiber end face 11 and a fiber core 12. The fiber end face 11 determines the coupling efficiency of the optical fiber 1. A high coupling efficiency means that the fiber end face 11 is capable of focusing efficiently into the fiber core 12 a light beam from a laser light 13 passing through the fiber end face 11.

Referring to FIGS. 2 and 3, there is shown a fiber end face polishing system 2 which is disclosed in Taiwanese Patent No. 1238097 entitled, "Optical Microlens polishing System and Method." The system 2 includes a support 21, a fiber holder 22, a polishing unit 23 and a moving unit 24. The fiber holder 22 is mounted on the support 21 to hold an optical fiber 20. The polishing unit 23 has a resilient pad 231 and a polishing film 232 fixed to the resilient pad 231. The polishing film 232 contacts the optical fiber 20 to polish the end face thereof.

The moving unit 24 has first, second third step motors 241, 242 and 243 that serve to provide three motions of different directions. The first step motor 241 is used to provide a linear movement along a first axis (M1) for the fiber holder 22, i.e., along an axis of the optical fiber 20. The second step motor 242 rotates the fiber holder 22. The third step motor 243 is used to move and adjust the optical fiber to an inclined position.

In use, the optical fiber 20 held by the fiber holder 22 is first moved linearly along the first axis (M1) to a predetermined point, and is inclined with the polishing unit 23 by an appropriate angle (M2). Afterwards, the second step motor 242 causes the optical fiber 20 to rotate about the first axis (M1) so that the optical fiber 20 is polished by the polishing film 232 until the end of the optical fiber 20 has a predetermined end face.

Since the polishing system 2 employs three step motors which require different control parameters, the construction and operation of the entire system are complicated. In addition, while the polishing system 2 can form the optical fiber end face into a hemisphere, a circular cone, a wedge shape, or a quadrangular pyramid shape, it is unable to provide an optical fiber with an asymmetric fiber end face or microlens that has good coupling with a high power laser having a high aspect ratio.

A symmetic fiber microlenses have been fabricated in the art by employing a multi-step grinding process or a complicated laser micromachining process. The multi-step grinding process is complicated due to the use of multiple grinding steps. Furthermore, because the multiple grinding steps are employed, it is difficult to have control over small offset of fiber microlens (i.e., the eccentricity between the center of the optical fiber and the microlens) to form reproducible elliptical fiber end faces or fiber microlenses, thus resulting in low yield fabrication.

SUMMARY OF THE INVENTION

An object of the present invention is to provide a novel fiber grinding process that employs a single grinding step to form a substantially cone-shaped end face having a non-circular cross section.

Another object of the invention is to provide a novel fiber grinding apparatus that has less complicated construction and that can produce a substantially cone-shaped end face having a non-circular cross section by employing a single grinding step.

Still another object of the invention is to provide an optical fiber with a substantially cone-shaped end face or microlens having a non-circular cross section, especially an elliptic cross section.

According to an aspect of the invention, a fiber grinding process comprises: inclining an optical fiber and contacting an end of the optical fiber with a grinding surface in such a manner that a central axis of the optical fiber at the end of the optical fiber is inclined with the grinding surface; grinding the optical fiber by rotating the optical fiber about the central axis; and changing a contact pressure between the end of the optical fiber and the grinding surface while rotating the optical fiber.

According to another aspect of the invention, an optical fiber includes a substantially cone-shaped end face with a substantially elliptic cross-section. The cone-shaped end face is formed by the aforesaid fiber grinding process.

According to still another aspect of the invention, a fiber grinding apparatus comprises a grinder having a grinding surface, a support, and a fiber carrier mounted on the support in a cantilever fashion. The fiber carrier has a ferrule holder that is rotatable about an inclined axis, that extends downwardly and inclinedly along the inclined axis and that is adapted to hold an optical fiber. The ferrule holder has a lower end extending toward the grinding surface and adapted to place an end of the optical fiber in contact with the grinding surface. The fiber grinding apparatus further comprises a rotating unit to rotate the ferrule holder, and a contact pressure changing unit mounted on the fiber carrier and having a moving mass for moving on the fiber carrier so that the lower end of the ferrule holder is moved toward or away from the grinding surface.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
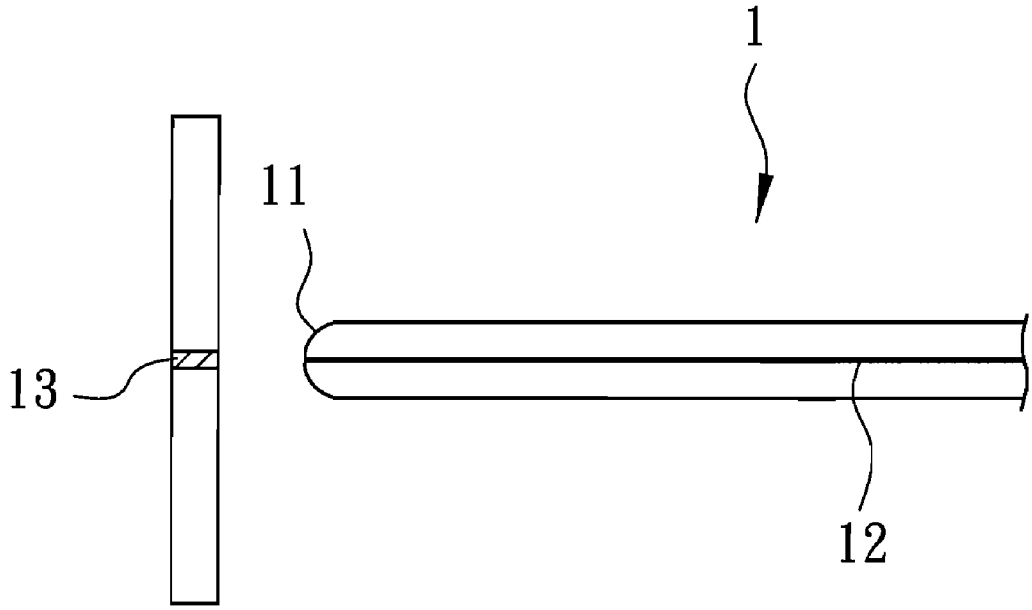
FIG. 1 PRIOR ART
FIG. 1 shows a typical optical fiber.
Figure 2:
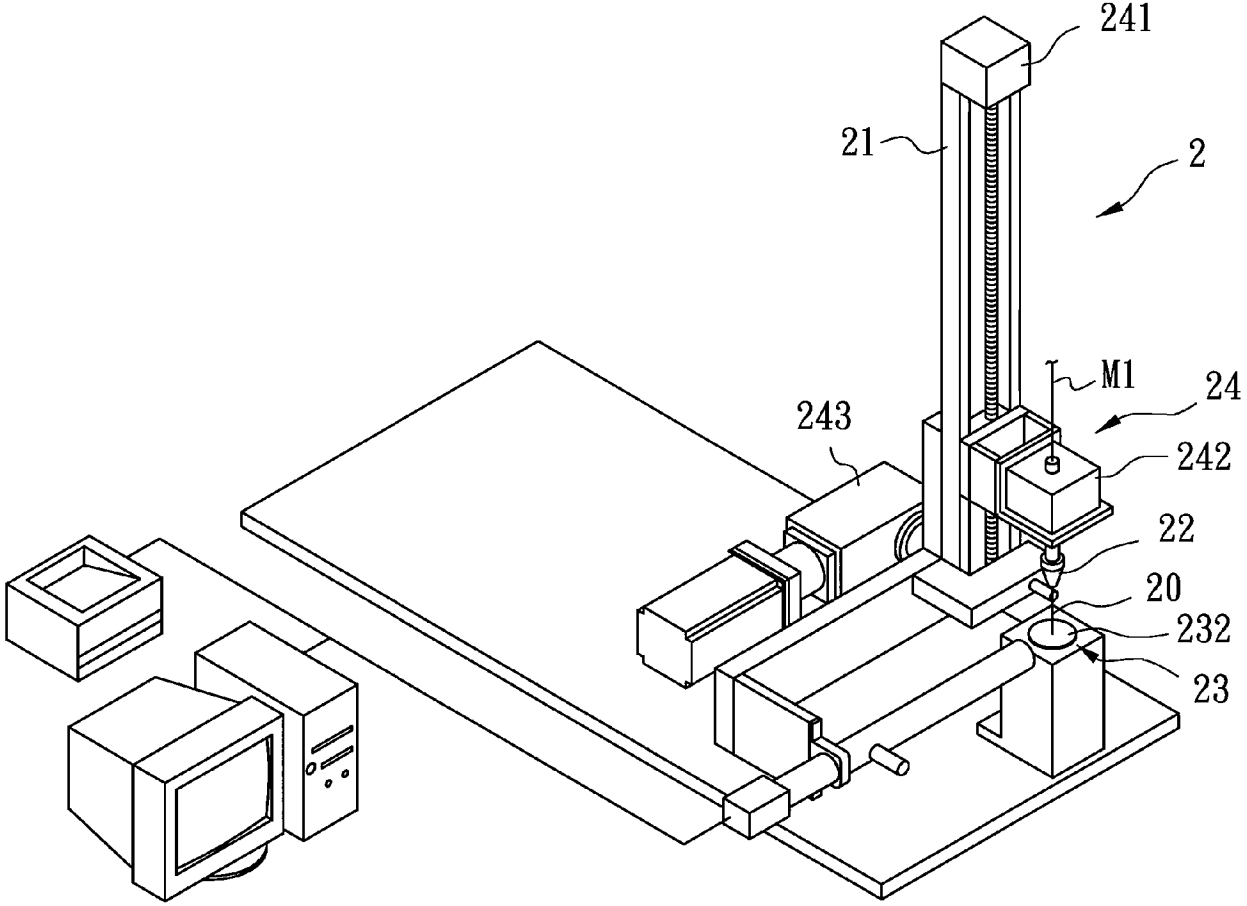
FIG. 2 PRIOR ART
FIG. 2 shows a conventional fiber grinding apparatus.
Figure 3:
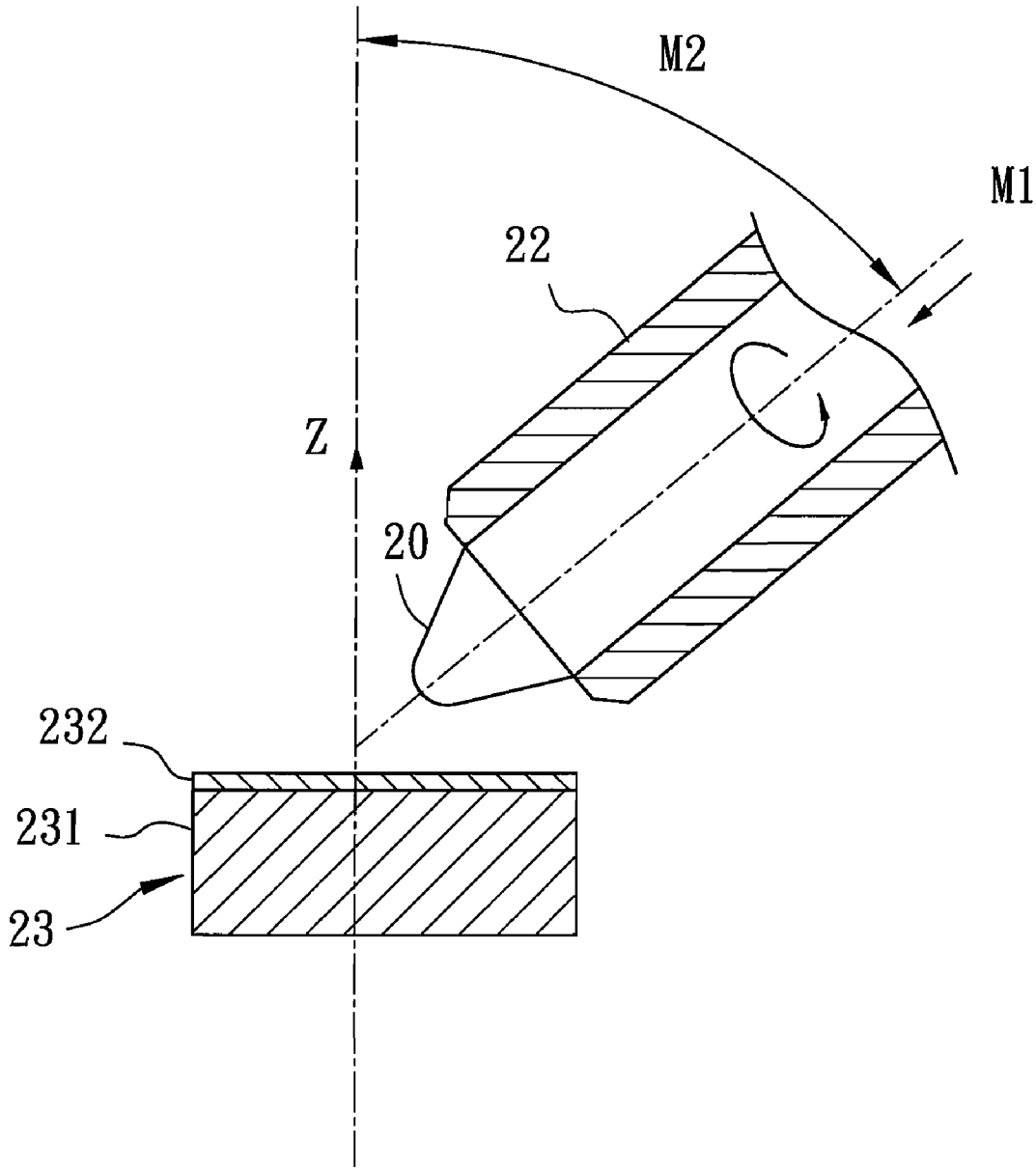
FIG. 3 PRIOR ART
FIG. 3 illustrates an optical fiber ground by the optical fiber grinding apparatus of FIG. 2.
Figure 4:
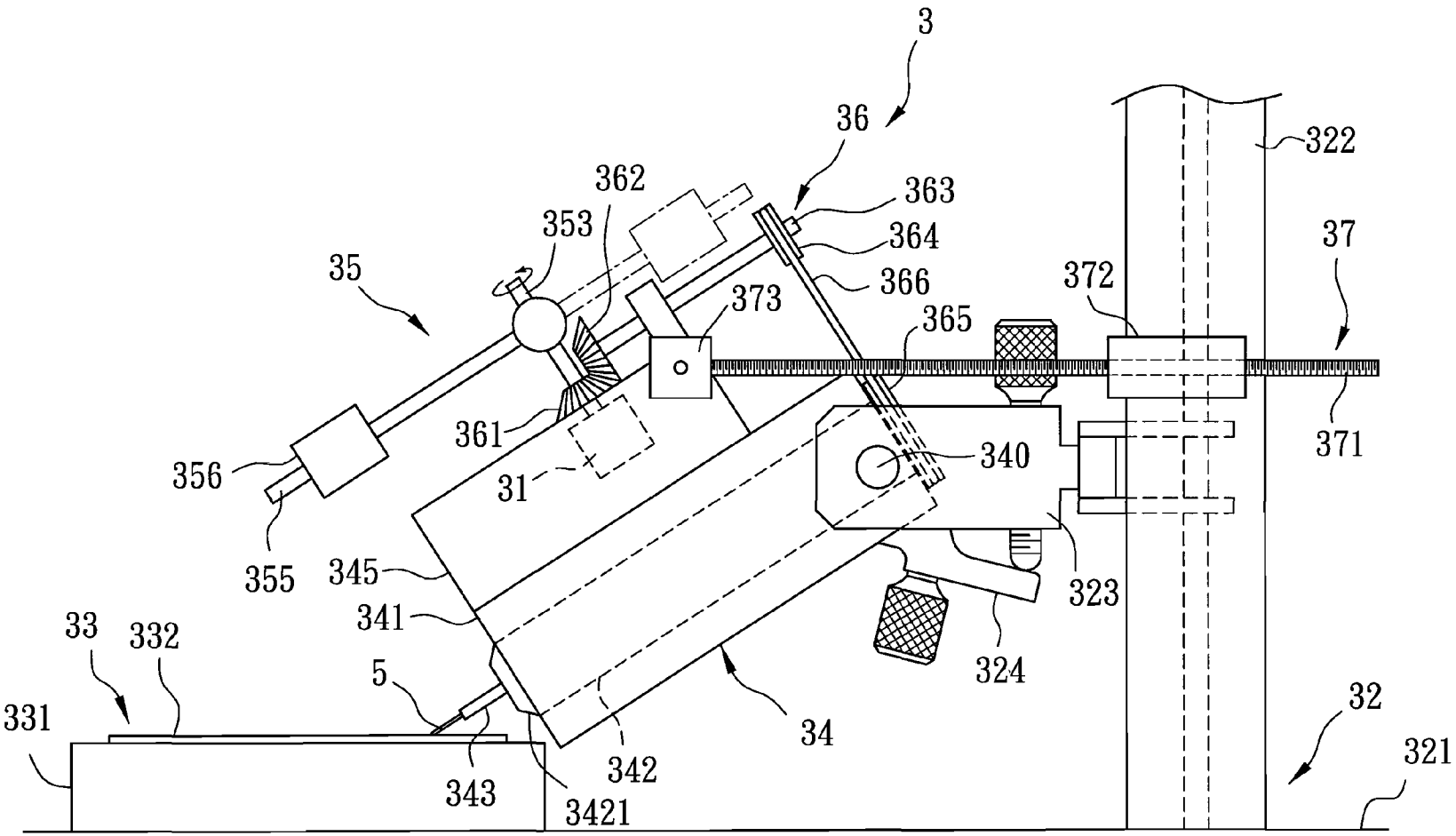
FIG. 4 is a schematic plan view showing a preferred embodiment of the fiber grinding apparatus according to the present invention.
Figure 5:
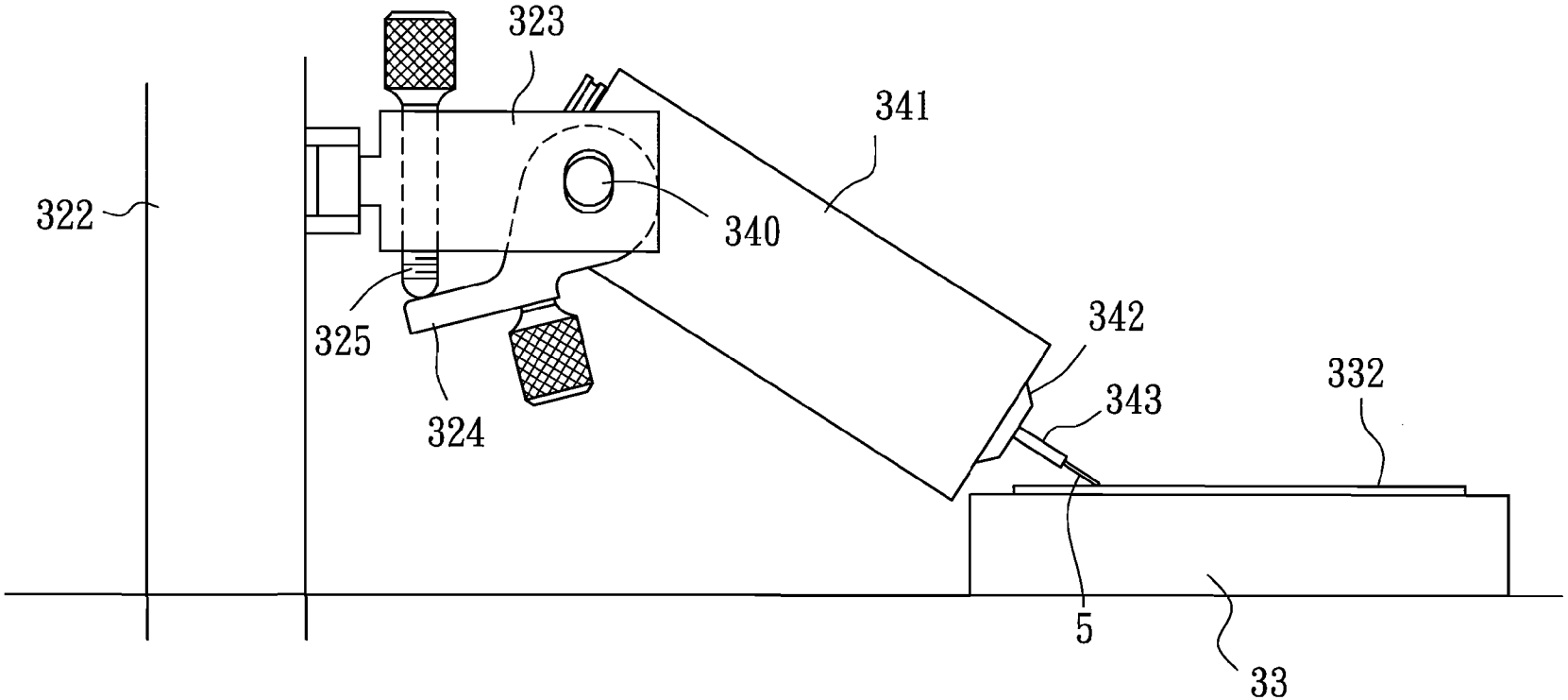
FIG. 5 is another schematic plan view of the preferred embodiment.
Figure 6:
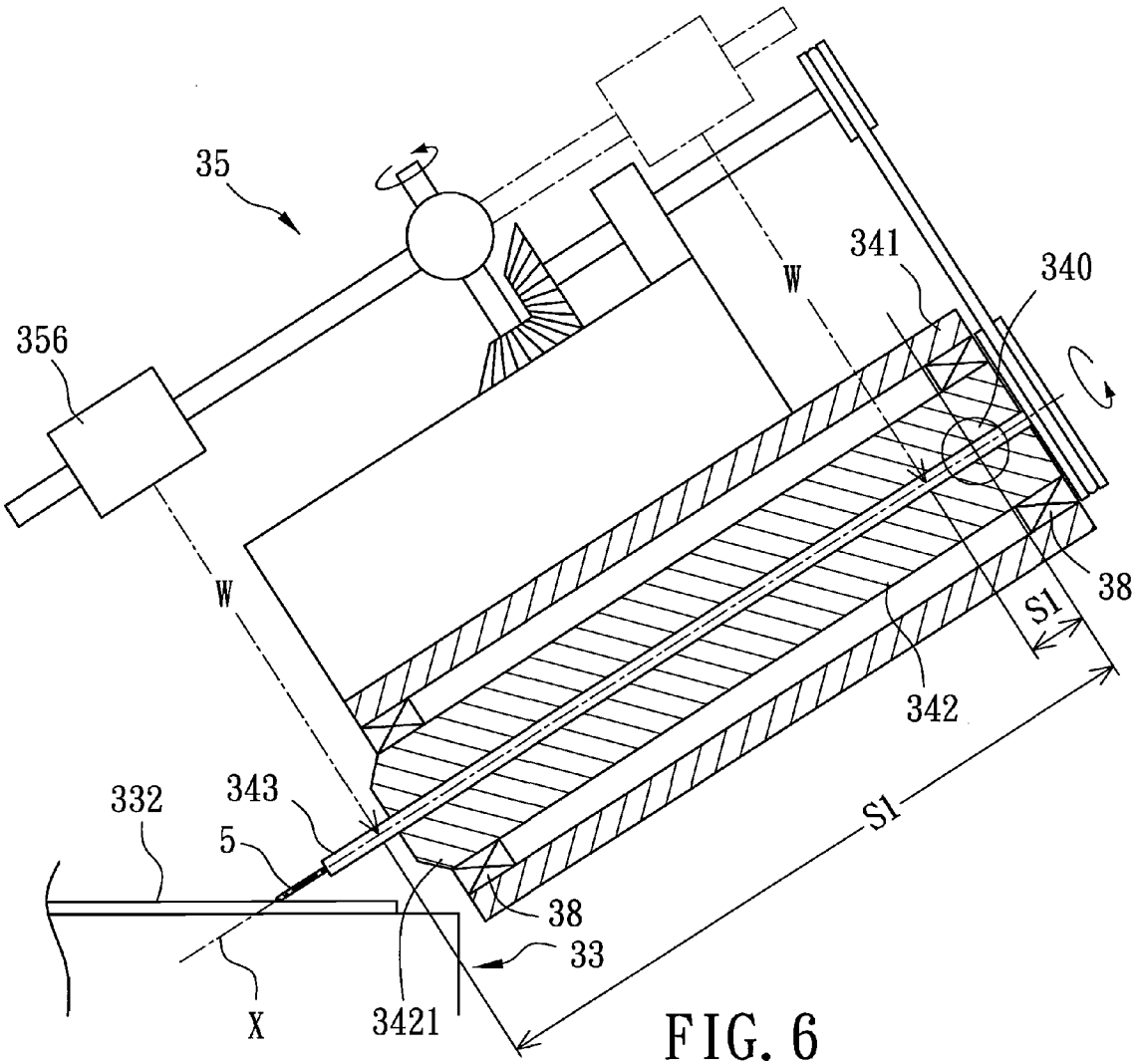
FIG. 6 shows how a contact pressure changing unit applies a variable torque to a ferrule holder.

Referring to FIGS. 4, 5 and 6, a fiber grinding apparatus 3 embodying the present invention includes a rotating unit 31, a support 32, a grinder 33, a fiber carrier 34 adapted to carry an optical fiber 5, a contact pressure changing unit 35, a transmission unit 36, and a counter-balancing unit 37.

The support 32 has a base seat 321, an upstanding frame 322, and a bracket 323 projecting from the upstanding frame 322.

The grinder 33 has a grinder seat 331 disposed on the base seat 321, and a grinding film 332 mounted on the grinder seat 331 to contact an end of the optical fiber 5.

The fiber carrier 34 has a housing 341, a ferrule holder 342 mounted rotatably within the housing 341 for rotation about an inclined axis (X) (shown in FIG. 6), and a ferrule 343 inserted in the ferrule holder 342 and receiving the optical fiber 5 along the inclined axis (X). The ferrule holder 342 extends downwardly and inclinedly along the inclined axis (X), and has a lower end 3421 extending toward a grinding surface of the grinding film 332 so that the end of the optical fiber 5 is in contact with the grinding surface.

The housing 341 has one end supported by the bracket 323 in a cantilever fashion. A free end of the housing 341 extends downwardly and inclinedly toward the grinder 33. Any suitable conventional means or method may be used to mount the housing 341 in a cantilever fashion. In this preferred embodiment, the end of the housing 341 is mounted on the bracket 323 using a bracket shaft 340. The bracket shaft 340 extends through the bracket 323 and the housing 341 so that the housing 341 is pivotal relative to the bracket 323. A lever 324 is connected to the bracket shaft 340 and is angled to the housing 341. A press member 325 is mounted adjustably and threadedly on the bracket 323 for upward or downward movement. As best shown in FIG. 5, the press member 325 presses the lever 324 so that the lever 324 turns counterclockwise to incline the housing 341 with respect to the grinder 33. In order to mount the ferrule holder 342 rotatably in the housing 341, two spaced apart bearing assemblies 38 are provided between the ferrule holder 342 and the housing 341. However, the present invention should not be limited thereto.

The contact pressure changing unit 35 is mounted on the fiber carrier 34 and has a moving mass 356 for moving on the fiber carrier 34. By moving the moving mass 356 on the fiber carrier 34, the lower end 3421 of the ferrule holder 342 can move toward or away from the grinding surface of the grinding film 332 to change a grinding/contact pressure between the end of the optical fiber 5 and the grinding surface of the grinder 33. In this preferred embodiment, the contact pressure changing unit 35 further includes a rotary shaft 353 which is mounted on the housing 341 above the ferrule holder 342. The moving mass 356 is connected eccentrically to the rotary shaft 353 above the ferrule holder 342 and is rotated by the rotary shaft 353 so that the moving mass 356 changes in position relative to the lower end 3421 of the ferrule holder 342 and applies a variable torque to the ferrule holder 342.

Preferably, the rotary shaft 353 is transverse to the inclined axis (X), and the moving mass 356 rotates about the rotary shaft 353 along a plane substantially parallel to the inclined axis (X) so that the moving mass 356 moves upward and downward periodically. When the moving mass 356 moves downward or toward the lower end 3421 of the ferrule holder 342, the lower end 3421 moves toward the grinding film 332 so that the grinding/contact pressure between the end of the optical fiber 5 and the grinding surface of the grinding film 332 is increased. When the moving mass 356 moves upward or away from the lower end 3421, the lower end 3421 moves away from the grinding surface so that the grinding/contact pressure is decreased.

In this preferred embodiment, the rotary shaft 353 is rotated by the rotating unit 31 which is mounted on a seat 345 fixed to the housing 341. The rotating unit 31 in this embodiment is a motor, and the rotary shaft 353 is an output shaft of the motor. The moving mass 356 is attached to one end of a connecting rod 355 that is connected perpendicularly to the rotary shaft 353. The rotating unit 31 also rotates the ferrule holder 342 through the transmission unit 36.

The transmission unit 36 includes a first bevel gear 361 connected to the rotary shaft 353, a second bevel gear 362 meshing the first bevel gear 361 and connected to a driven shaft 363, a driving wheel 364 connected to the driven shaft 363, a driven wheel 365 connected to the ferrule holder 342, and a transmission belt 366 passing over the driving wheel 364 and the driven wheel 365. Through the transmission unit 36, the ferrule holder 342 can rotate about the inclined axis (X).

The counter-balancing unit 37 is connected to the seat 345 of the fiber carrier 34 for balancing the fiber carrier 34 during operation, and basically includes a counterweight 372 for applying to the fiber carrier 34 a torque opposite to the torque applied by the contact pressure changing unit 35 and for the static balancing of the fiber carrier 34. In this embodiment, the counterweight 372 is threadedly mounted on a screw rod 371 which has one end fixed to a fixing block 373 attached to the seat 345 of the fiber carrier 34. The screw rod 371 has a free end extending away from the moving mass 356 and the bracket shaft 340 that supports the fiber carrier 34. By adjusting the position of the counterweight 372 on the screw rod 371, the center of gravity of the fiber carrier 34 may be controlled to keep the fiber carrier 34 in balance.

A preferred embodiment of the fiber grinding process according to the present invention may be carried out by using the fiber grinding apparatus 3. Referring once again to FIGS. 4-6, the optical fiber 5 is placed within the ferrule 343. As the ferrule 343 is inclined with respective to the grinding surface of the grinding film 332, the optical fiber 5 is also inclined with the grinding surface. As best shown in FIG. 6, the central axis of the optical fiber 5 coincides with the inclined axis (X) of the ferrule holder 342. The end of the optical fiber 5 contacts the grinding surface of the grinding film 332 with the central axis of the optical fiber 5 at the end of the optical fiber 5 being inclined with the grinding surface.

The optical fiber 5 is rotated and ground when the ferrule holder 342 is rotated through the motor or the rotating unit 31 and the transmission unit 36. As the motor or the rotating unit 31 is connected to the contact pressure changing unit 35, it also operates the contact pressure changing unit 35 while rotating the ferrule holder 342 and the optical fiber 5. During operation, the moving mass 356 rotates and moves upward and downward alternately or periodically along a circular path extending in a plane substantially parallel to the inclined axis (X) or the central axis of the optical fiber 5. A variable torque is applied to the ferrule holder 342 while the moving mass 356 moves upward and downward periodically. The moving mass 356 reaches the highest point one time and reaches the lowest point one time for each cycle motion thereof.

The rate of grinding the optical fiber 5, i.e. the rate of removing the material from the optical fiber 5 during the grinding operation, depends on the contact or grinding pressure between the grinding surface of the grinding film 332 and the end of the optical fiber 5. The contact or grinding pressure varies when the torque applied to the ferrule holder 342 by the moving mass 356 is varied.

Referring once again to FIG. 6, the variable torque applied to the ferrule holder 342 may be determined from the cross product of a lever arm (S1) with a force component (W) applied normally by the moving mass 356 to the ferrule holder 342. When the moving mass 356 moves downward and toward the lower end 3421 of the ferrule holder 342, the lever arm (S1) is lengthened so that the torque is increased and the lower end 3421 turns downward and toward the grinding film 332. When the moving mass 356 moves upward and away from the lower end 3421, the lever arm (S1) is shortened so that the torque is decreased and the lower end 3421 turns upward and away from the grinding film 332. When the moving mass 356 reaches the lowest point, the torque is maximum, and the grinding pressure is the largest. When the moving mass 356 reaches the highest point, the torque is minimum, and the grinding pressure is the smallest.

Figure 7:
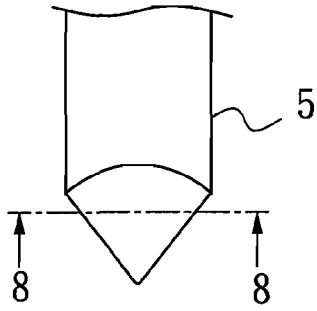
FIG. 7 is a fragmentary view of a cone-shaped end face of an optical fiber produced by the preferred embodiment.
Figure 8:
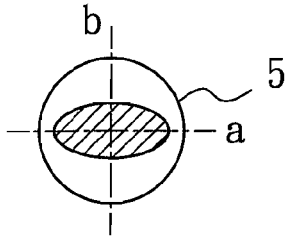
FIG. 8 is a sectional view taken along line 8-8 of FIG. 7.

Since the torque changes periodically between maximum and minimum torques, the rate of removing the material of the optical fiber 5 varies between maximum and minimum rates periodically. The variable torque may be applied to the ferrule holder 342 as a function of the rotating angle of the optical fiber 5. In an example, the end of the optical fiber 5 is formed into a substantially elliptic cone-shaped end face as shown in FIGS. 7 and 8. To achieve the elliptic cone-shaped end face, the moving mass 356 makes two revolutions for each revolution of the ferrule holder 342 in order to apply two maximum torques respectively at the fiber rotating angles of 90° and 270° and to apply two minimum torques respectively at the optical fiber rotating angles of 180° and 360°. The cone-shaped end face has an elliptic cross section with a major axis (a) and a minor axis (b). Therefore, the cone-shaped end face has two radii of curvatures. By changing the amplitude of the variable torque, different aspect ratios of the elliptic cone-shaped end faces may be obtained.

After the end of the optical fiber 5 is ground and formed into the cone-shaped end face, the cone-shaped end face is subjected to a fusion process. Preferably, the fusion process is carried out by arc welding. With the fusion process, the curvatures of the cone-shaped end face can be modified, controlled and polished.

Figure 9:
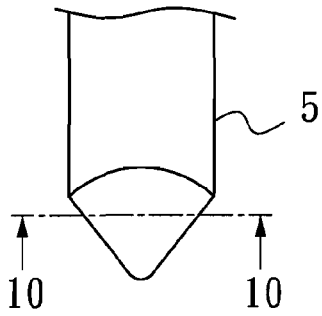
FIG. 9 is a fragmentary view of another cone-shaped end face.
Figure 10:
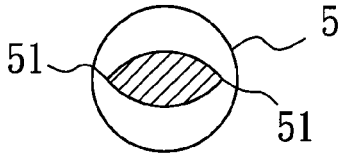
FIG. 10 is a sectional view taken along line 10-10 of FIG. 9.

As described hereinbefore, the counterweight 372 of the counter-balancing unit 37 is adjustable in position to keep the fiber carrier 34 in balance and to provide a proper contact pressure for the end of the optical fiber 5. However, if the variable torque applied by the moving mass 356 is smaller than the torque applied by the counterweight 372 when the moving mass 356 moves to the highest point, the fiber carrier 34 will turn clockwise or upward, and the end of the optical fiber 5 will not contact the grinding film 332, thereby resulting in insufficient grinding and hence imperfections, such as sharp edges 51, in the cone-shaped end face of the optical fiber 5 as shown in FIGS. 9 and 10. Such sharp edges 51 may be trimmed and corrected by the fusion process.

Compared to the prior art, the fiber grinding process and apparatus according to the present invention are less complicated and easy for automation, and employs a single continuous grinding step that can be carried out easily to produce the cone-shaped end face or microlens. The elliptic cone-shaped end face or microlenses produced by the present invention can achieve a high coupling efficiency and is suitable for use in commercial high-power pumping laser modules. The single grinding step employed in the present invention is advantageous in the control over two radii of curvatures of the elliptic cone-shaped end face or microlenses and a very small fiber offset so that good and reproducible elliptic end faces can be produced.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

We claim:

1. A fiber grinding process comprising:

inclining an optical fiber and contacting an end of the optical fiber with a grinding surface in such a manner that a central axis of the optical fiber at the end of the optical fiber is inclined with respect to the grinding surface;

grinding the optical fiber by rotating the optical fiber about the central axis; and changing a contact pressure between the end of the optical fiber and the grinding surface while rotating the optical fiber, wherein the changing of the contact pressure and the rotating of the optical fiber are carried simultaneously by installing the optical fiber in a ferrule holder and by rotating the ferrule holder about the central axis while moving the ferrule holder toward and away from the grinding surface.

2. The fiber grinding process of claim 1, wherein the changing of the contact pressure is carried out by applying a variable torque to the ferrule holder.

3. The fiber grinding process of claim 2, wherein the variable torque varies periodically between a maximum torque and a minimum torque.

4. An optical fiber comprising a substantially cone-shaped end face with a substantially elliptic cross-section, said end face being formed by the fiber grinding process of claim 1.

5. A fiber grinding apparatus comprising:

a grinder having a grinding surface;

a support;

a fiber carrier mounted on said support in a cantilever fashion, said fiber carrier having a ferrule holder that is rotatable about an inclined axis, that extends downwardly and inclinedly along said inclined axis and that is adapted to hold an optical fiber, said ferrule holder having a lower end extending toward said grinding surface and adapted to place an end of the optical fiber in contact with said grinding surface;

a rotating unit to rotate said ferrule holder; and a contact pressure changing unit mounted on said fiber carrier and having a moving mass for moving on said fiber carrier so that said lower end of said ferrule holder is moved toward or away from said grinding surface, wherein said contact pressure changing unit further has a rotary shaft mounted on said fiber carrier, said moving mass being connected eccentrically to said rotary shaft above said ferrule holder and being rotatable about said rotary shaft to apply a variable torque to said ferrule holder so that said lower end of said ferrule holder changes in position relative to said grinding surface.

6. The fiber grinding apparatus of claim 5, wherein said rotary shaft is transverse to said inclined axis, and said moving mass rotates about said rotary shaft and moves upward and downward periodically.

7. The fiber grinding apparatus of claim 5, wherein said rotary shaft is connected to said rotating unit so that said rotating unit drives both of said rotary shaft and said ferrule holder.

8. The fiber grinding apparatus of claim 7, wherein said fiber carrier further includes a housing connected to said support in the cantilever fashion, said ferrule holder being mounted rotatably within said housing.

9. The fiber grinding apparatus of claim 8, wherein said rotating unit is a motor mounted on said housing above said ferrule holder, said rotary shaft being an output shaft of said motor, said rotary shaft being further connected to said ferrule holder.

10. The fiber grinding apparatus of claim 9, further comprising a transmission unit connected to said rotary shaft and said ferrule holder.

* * * * *